US008092155B2

(12) United States Patent
Tsen

(10) Patent No.: US 8,092,155 B2
(45) Date of Patent: Jan. 10, 2012

(54) LIGHT-EMITTING FAN

(75) Inventor: Chih-Chun Tsen, Taoyuan (TW)

(73) Assignee: Enermax Technology Corporation, Taoyuan (TW)

( * ) Notice: Subject to any disclaimer, the term of this patent is extended or adjusted under 35 U.S.C. 154(b) by 730 days.

(21) Appl. No.: 12/232,401

(22) Filed: Sep. 17, 2008

(65) Prior Publication Data

US 2010/0040457 A1 Feb. 18, 2010

(30) Foreign Application Priority Data

Aug. 15, 2008 (TW) ..... 97214688 U

(51) Int. Cl.
*F04D 29/00* (2006.01)

(52) U.S. Cl. ..... 415/118; 416/5

(58) Field of Classification Search ..... 415/118, 415/121.3, 176, 177; 416/5
See application file for complete search history.

(56) References Cited

U.S. PATENT DOCUMENTS 7,425,116 B2 * 9/2008 Chang ..... 416/5
7,563,070 B2 * 7/2009 Lin et al. ..... 415/118
7,737,462 B2 * 6/2010 Oishi et al. ..... 257/99

* cited by examiner

*Primary Examiner* — Quoc Hoang
(74) *Attorney, Agent, or Firm* — Chun-Ming Shih; HDLS IPR Services

(57) ABSTRACT

A light-emitting fan includes a frame, a vane, at least one flexible circuit structures, and a plurality of light-emitting elements. The van is pivotally provided on the frame. The van has a hub and a plurality of blades connected to the hub. The flexible circuit structure is circumferentially provided on the frame. The light-emitting elements are provided on the flexible circuit structure to emit light respectively. With the above arrangement, the light-emitting elements can be combined with the frame easily via the flexible circuit structure.

15 Claims, 10 Drawing Sheets

LIGHT-EMITTING FAN

BACKGROUND OF THE INVENTION

1. Field of the Invention

The present invention relates to a fan, and in particular to a light-emitting fan in which a flexible circuit structure is combined with light-emitting elements to emit light via the light-emitting elements.

2. Description of Related Art

Please refer to FIG. 1. A conventional light-emitting fan includes a frame 1*a*. The center of the frame 1*a* is pivotally provided with a vane 2*a* having a plurality of blades 21*a*. Four corners of the frame la are provided with a light-emitting diode 3*a* respectively, so that the four light-emitting diodes 3*a* can emit light.

However, when the light-emitting diodes 3*a* are mounted in the above-mentioned light-emitting fan, the frame 1*a* has to be additionally formed with a structure for mounting the light-emitting diodes 3*a* (such as mounting holes). Furthermore, leads (not shown) are used to connect the light-emitting diodes. As a result, the difficulty in manufacturing the frame la is increased, and it is inconvenient to assemble the fan.

Consequently, because of the above limitation resulting from the technical design of prior art, the inventor strives via real world experience and academic research to develop the present invention, which can effectively improve the limitations described above.

SUMMARY OF THE INVENTION

The object of the present invention is to provide a light-emitting fan. A frame is provided therein with a flexible circuit structure, so that light-emitting elements can be combined with the frame easily via the flexible circuit structure.

In order to achieve the above objects, the present invention provides a light-emitting fan, which includes: a frame, a vane pivotally provided on the frame, the van having a hub and a plurality of blades connected to the hub; at least one flexible circuit structures circumferentially provided on the frame; and a plurality of light-emitting elements provided on the flexible circuit structure and electrically connected thereto.

The present invention has advantageous features as follows. In the light-emitting fan of the present invention, a plurality of light-emitting elements is provided on the flexible circuit structure, and the flexible circuit structure is combined on the frame. Therefore, the light-emitting elements can be combined to the frame more easily. In this way, the whole construction of the fan is simplified, so that it is easier to manufacture and assemble the fan.

In order to further understand the characteristics and technical contents of the present invention, a detailed description relating thereto will be made with reference to the accompanying drawings. However, the drawings are illustrative only, but not used to limit the scope of the present invention.

DETAILED DESCRIPTION OF PREFERRED EMBODIMENTS

Figure 1:
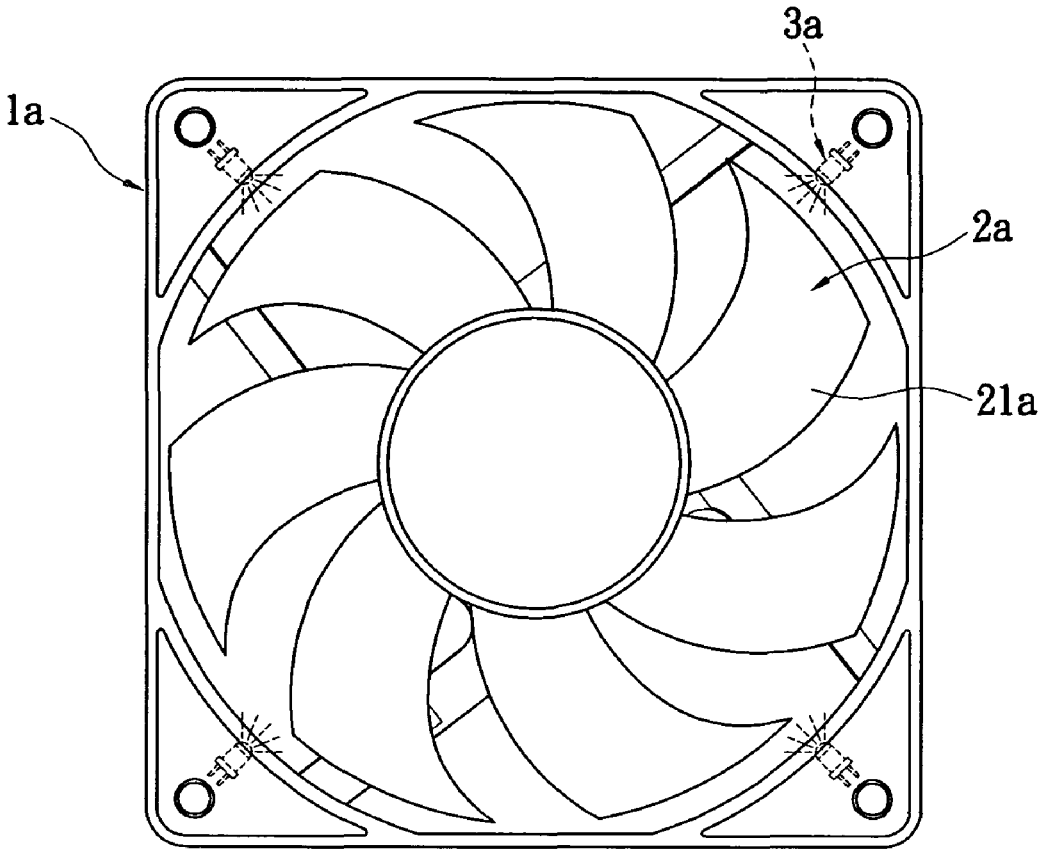
FIG. 1 PRIOR ART
FIG. 1 is an assembled perspective view showing a conventional light-emitting fan.
Figure 2:
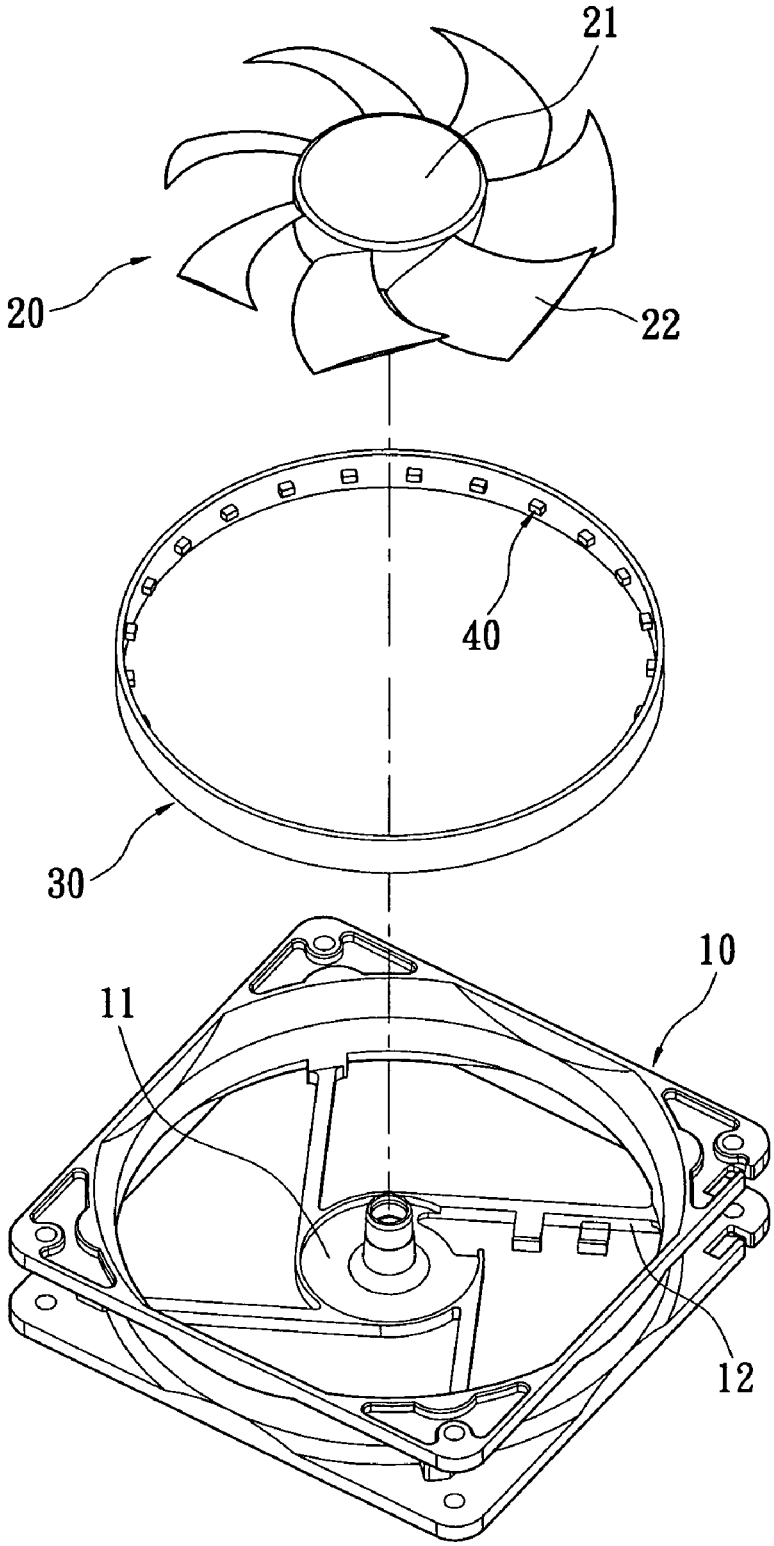
FIG. 2 is an exploded perspective view showing the light-emitting diode according to the first embodiment of the present invention.
Figure 3:
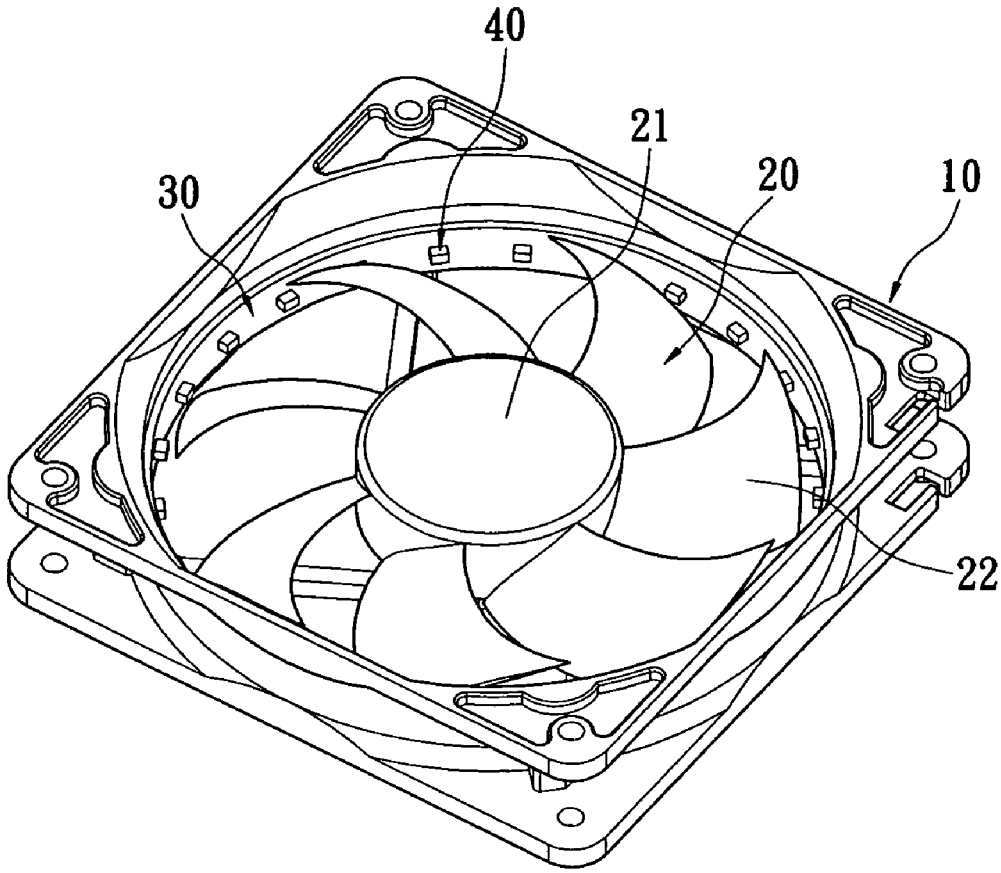
FIG. 3 is an assembled perspective view showing the light-emitting diode according to the first embodiment of the present invention.

Please refer to FIGS. 2 and 3. The first embodiment of the present invention provides a light-emitting fan, which includes a frame 10, a vane 20, a flexible circuit structure 30, and a plurality of first light-emitting elements 40. The center of the frame 10 is provided with a base 11 and a plurality of ribs 12 connected with the base 11.

The vane 20 has a hub 21 and a plurality of blades 22. The blades 22 are connected to the periphery of the hub 21 at intervals. The vane 20 is pivotally provided to the base 11 of the frame 10 via the hub 21.

In the present embodiment, the flexible circuit structure 30 is a flexible printed circuit board and encircles to form a ring, but it is not limited thereto. The flexible circuit structure 30 is provided in the inner edge of the frame 10. The way of combining the flexible circuit structure 30 with the frame 10 is not limited to a specific one, and various suitable means can be used, such as adhering, via screws, locking, or the like.

The form of the first light-emitting element 40 is not limited to a specific one, and it can be light-emitting diodes of various forms or other light-emitting elements. The color of the light emitted by the light-emitting elements is not limited to a specific color. In the present embodiment, the first light-emitting elements 40 are surface mount type light-emitting diodes. The first light-emitting elements 40 are provided on one side of the flexible circuit structure 30 adjacent to the vane 20, and are electrically connected to the flexible circuit structure 30 respectively, thereby forming a ring-like arrangement. The first light-emitting elements 40 emit light toward the vane 20 respectively. In the present embodiment, the number of the first light-emitting elements 40 is greater than or equal to the number of the blades 22 of the vane 20. Via this constitution, the light-emitting fan of the present invention can be obtained.

When the vane 20 of the fan rotates, the first light-emitting elements 40 will emit light simultaneously to illuminate the surfaces of the blades 22. Since the vane 20 rotates continuously, patterns with a shining visual effect are represented on the blades 22. Furthermore, the first light-emitting elements 40 form a ring of light surrounding the vane 20, which will increase the visual effect to a further extent.

Additionally, the material of the frame 10 and vane 20 is not limited to a specific one, and they can be made of opaque, transparent, or translucent material. Preferably, the vane 20 is made of transparent or translucent materials. In this way, with the light emitted by the first light-emitting elements 40, the surfaces of the blades 22 can generate shining patterns like whirlpools.

Figure 4:
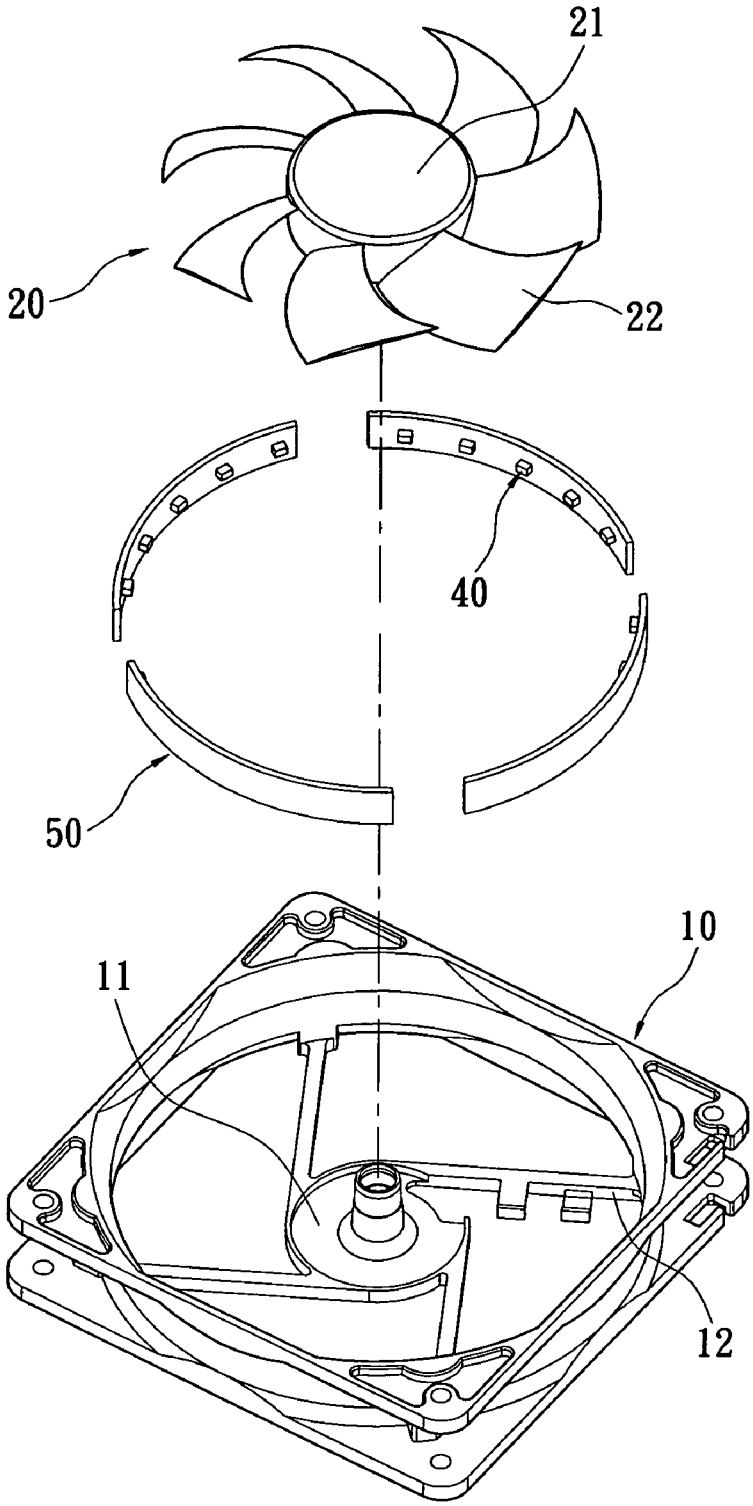
FIG. 4 is an exploded perspective view showing the light-emitting diode according to the second embodiment of the present invention.

Please refer to FIG. 4, which shows a second embodiment of the light-emitting fan of the present invention. The difference between the second embodiment and the first embodiment lies in the fact as follows.

The fan includes a plurality of flexible circuit structures 50. The flexible circuit structures 50 are circumferentially provided on the inner edge of the frame 10 at intervals. The first light-emitting elements 40 are divided into a plurality of groups and provided on one side of the flexible circuit structures 50 adjacent to the vane 20 respectively.

Figure 5:
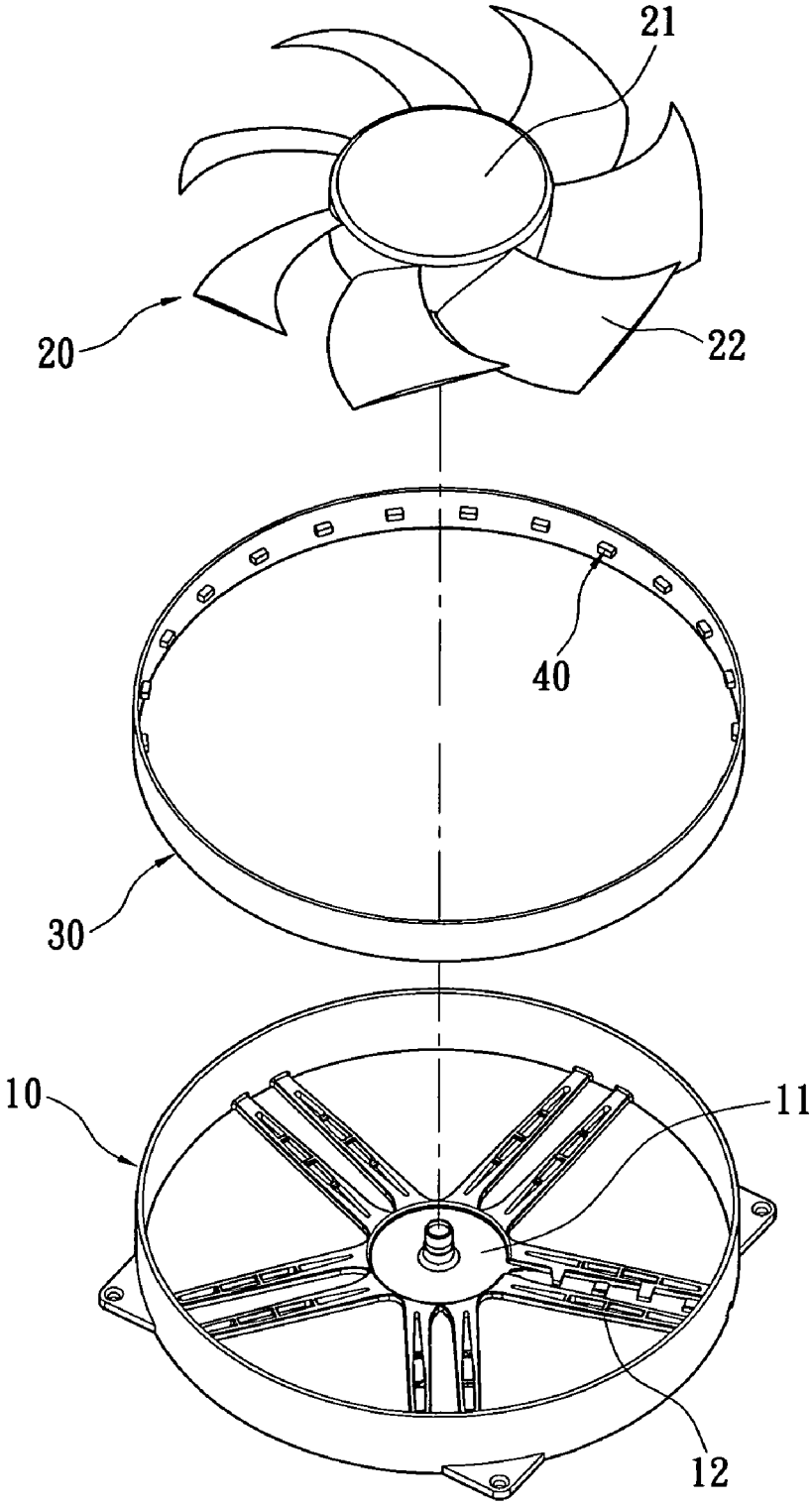
FIG. 5 is an exploded perspective view showing the light-emitting diode according to the third embodiment of the present invention.
Figure 6:
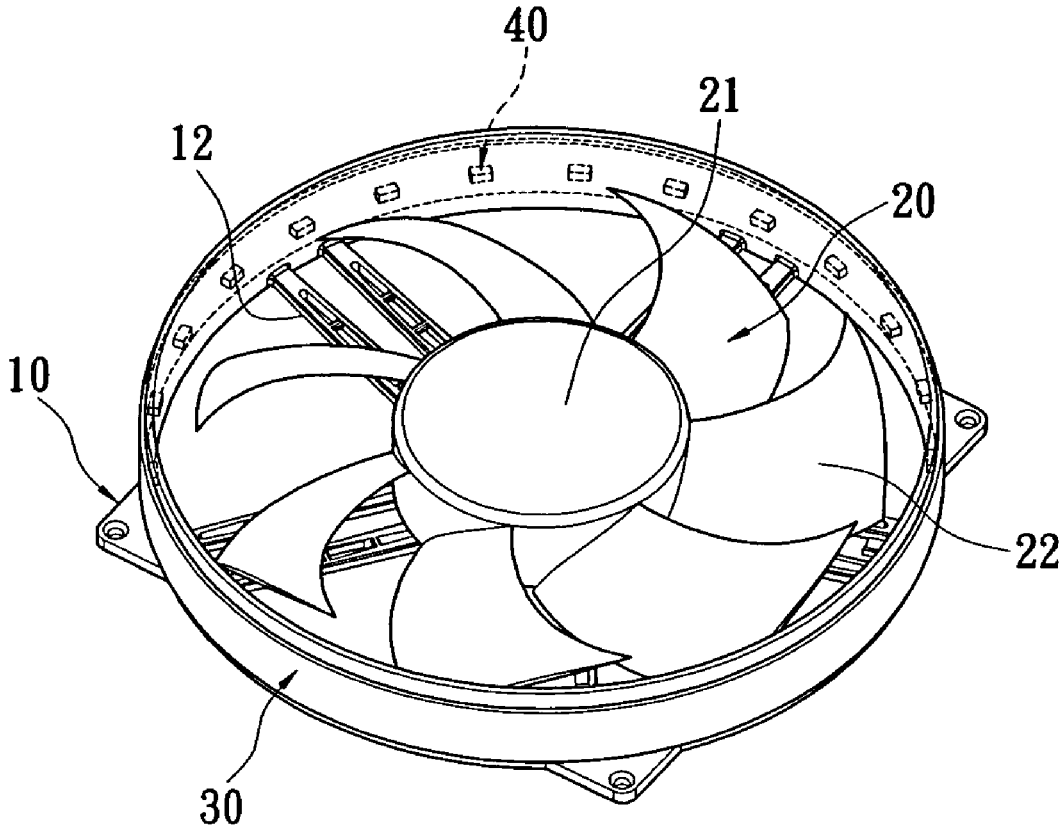
FIG. 6 is an assembled perspective view showing the light-emitting diode according to the third embodiment of the present invention.

Please refer to FIGS. 5 and 6, which show a third embodiment of the light-emitting fan of the present invention. The difference between the third embodiment and the first embodiment lies in the fact as follows.

The frame 10 is made of a transparent material. The flexible circuit structure 30 is provided on an outer edge of the frame 10. The first light-emitting elements 40 are located between the frame 10 and the flexible circuit structure 30. Since the frame 10 is transparent, the light emitted by the first light-emitting elements 40 can illuminate the vane 20 directly, thereby generating a shining visual effect.

Figure 7:
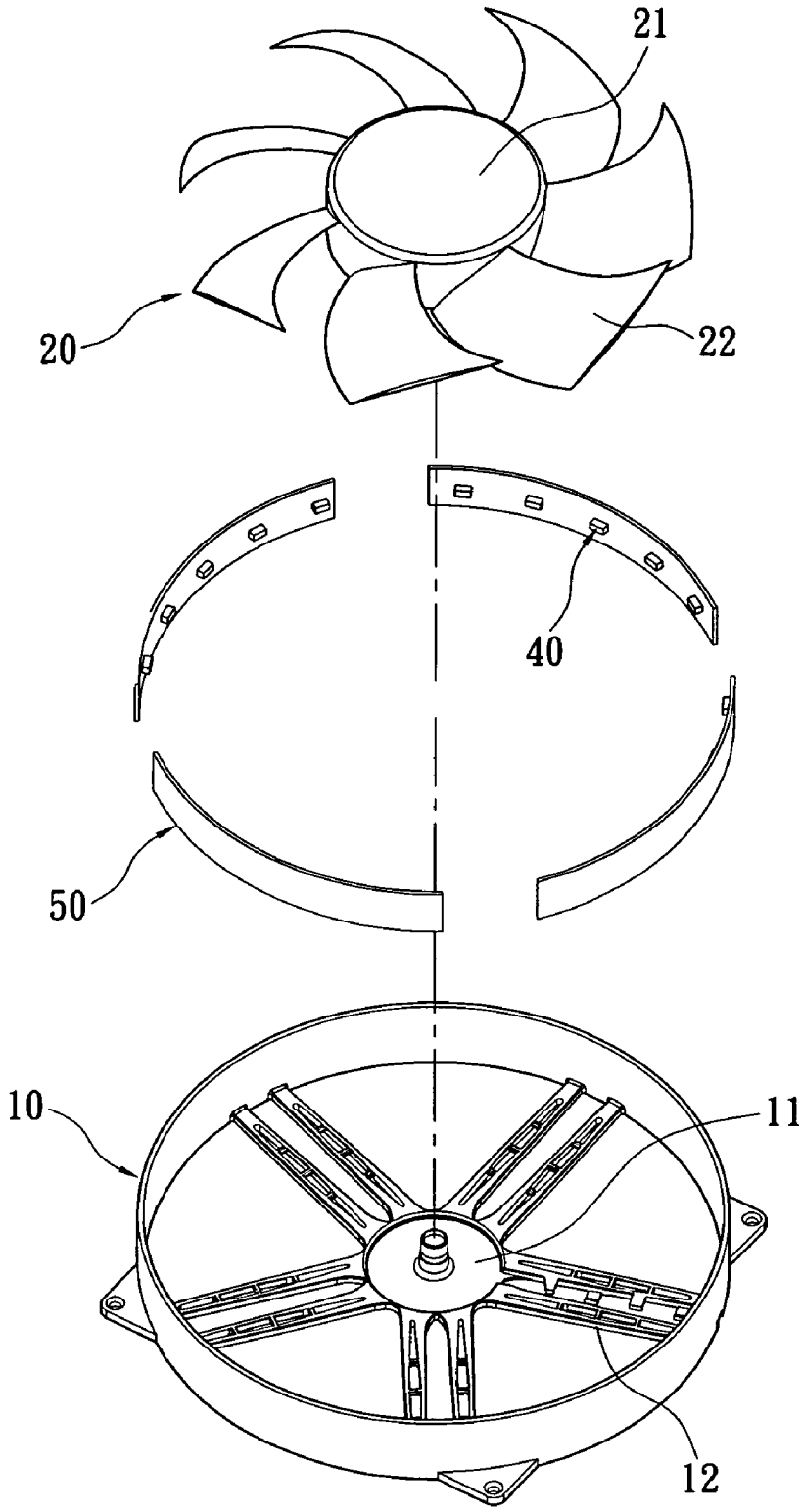
FIG. 7 is an exploded perspective view showing the light-emitting diode according to the fourth embodiment of the present invention.

Please refer to FIG. 7, which shows a fourth embodiment of the light-emitting fan of the present invention. The difference between the fourth embodiment and the third embodiment lies in the fact as follows.

The fan includes a plurality of flexible circuit structures 50. The flexible circuit structures 50 are circumferentially provided on the outer edge of the frame 10 at intervals. The first light-emitting elements 40 are divided into a plurality of groups and provided on one side of the flexible circuit structures 50 adjacent to the vane 20 respectively.

Figure 8:
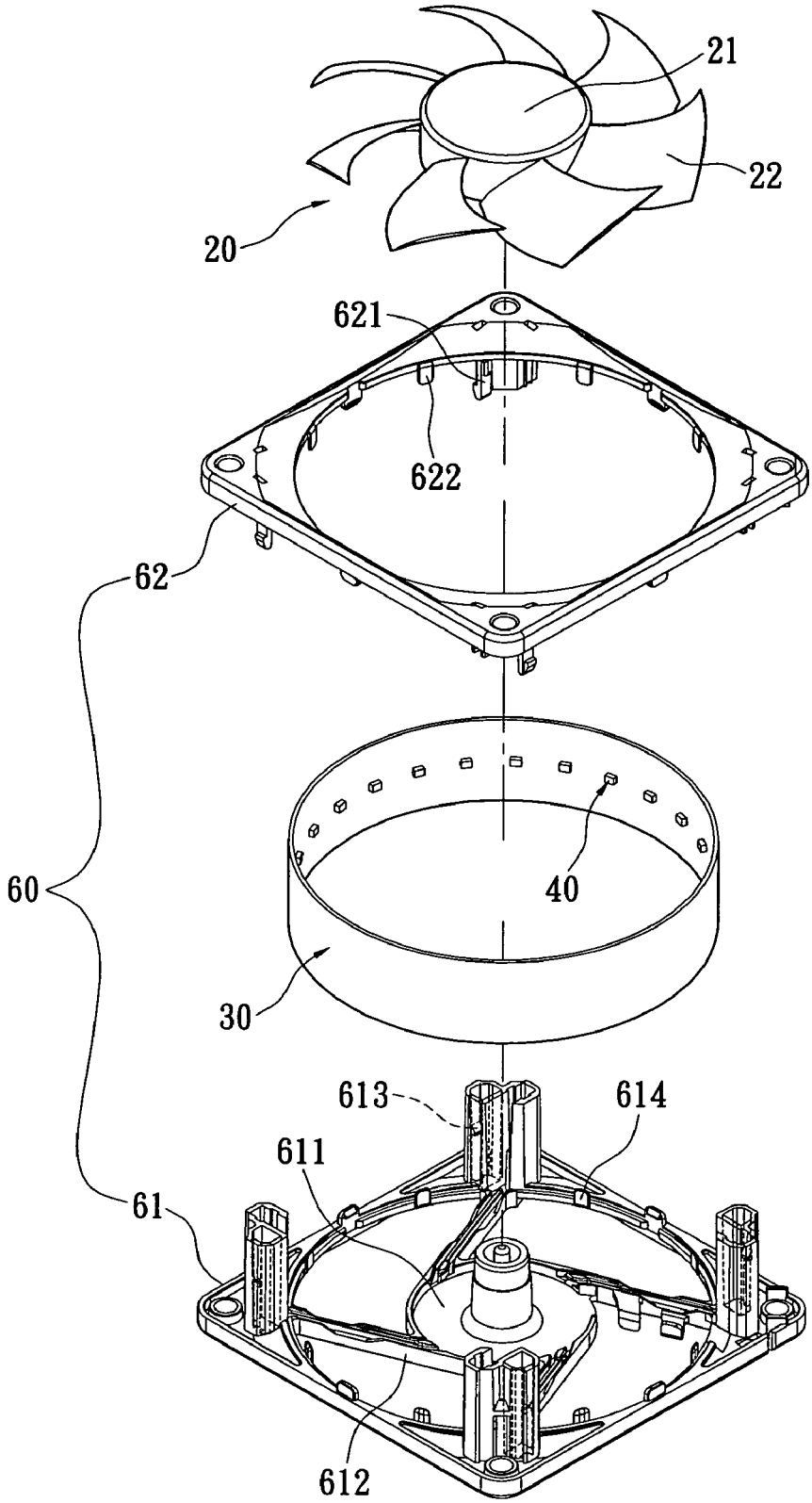
FIG. 8 is an exploded perspective view showing the light-emitting diode according to the fifth embodiment of the present invention.
Figure 9:
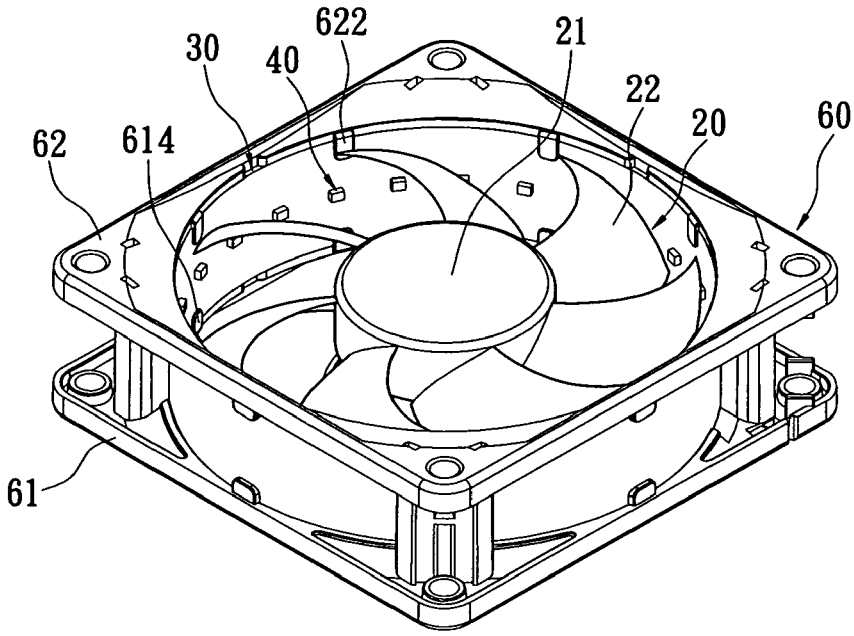
FIG. 9 is an assembled perspective view showing the light-emitting diode according to the fifth embodiment of the present invention.

Please refer to FIGS. 8 and 9, which show a fifth embodiment of the light-emitting fan of the present invention. The difference between the fifth embodiment and the first embodiment lies in the fact as follows.

The frame 60 is designed as two pieces, which includes a first casing 61 and a second casing 62. The center of the first casing 61 is provided with a base 611 and a plurality of ribs 612 connected to the base 611. The first casing 61 and the second casing 62 are provided with locking portions 613 and locking portions 621 respectively. The locking portions 613 of the first casing 61 can be locked to the locking portions 621 of the second casing 62 correspondingly. In this way, the first casing 61 and the second casing 62 can be combined with each other to form a frame 60.

The first casing 61 and the second casing 62 are respectively provided with a plurality of assembling portions 614 and assembling portions 622 corresponding to the flexible circuit structure 30. The flexible circuit structure 30 similarly encircles to form a ring. Both sides of the flexible circuit structure 30 are assembled with the first casing 61 and the second casing 62 respectively via the assembling portions 614, 624, so that the flexible circuit structure 30 can be clamped and fixed between the first casing 61 and the second casing 62.

Figure 10:
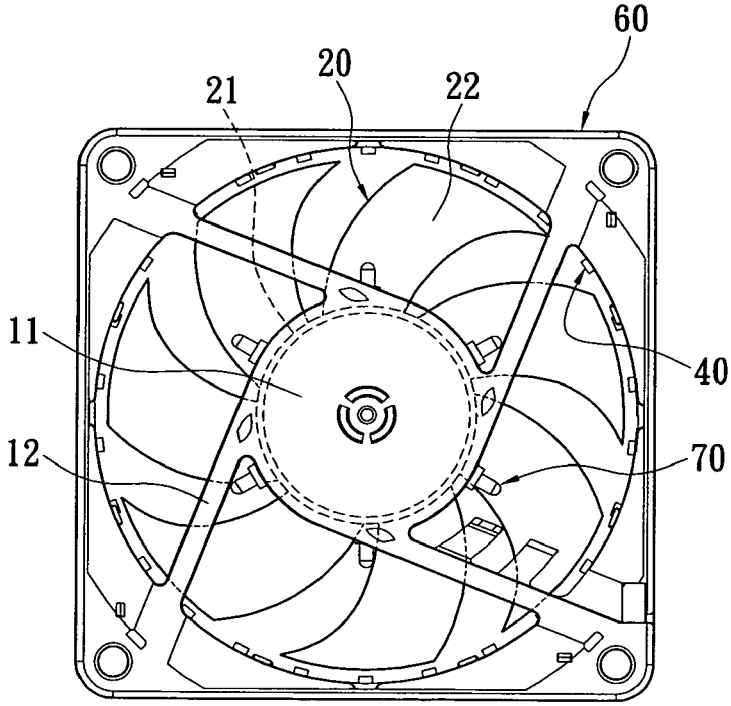
FIG. 10 is a bottom view showing the light-emitting diode according to the sixth embodiment of the present invention.

Please refer to FIG. 10, which shows a sixth embodiment of the light-emitting fan of the present invention. The difference between the sixth embodiment and the fifth embodiment lies in the fact as follows.

In addition to a plurality of first light-emitting elements 40, the fan also includes a plurality of second light-emitting elements 70. In the present embodiment, the second light-emitting elements 70 are shell-like light-emitting diodes, but they are not limited thereto. The second light-emitting elements 70 are electrically connected to the circuit board (not shown) within the base 611 of the frame 60. The second light-emitting elements 70 are circumferentially provided on the base 611, so that the fan is provided with the light-emitting elements 40, 70 at different portions, thereby forming a changeable visual effect.

Figure 11:
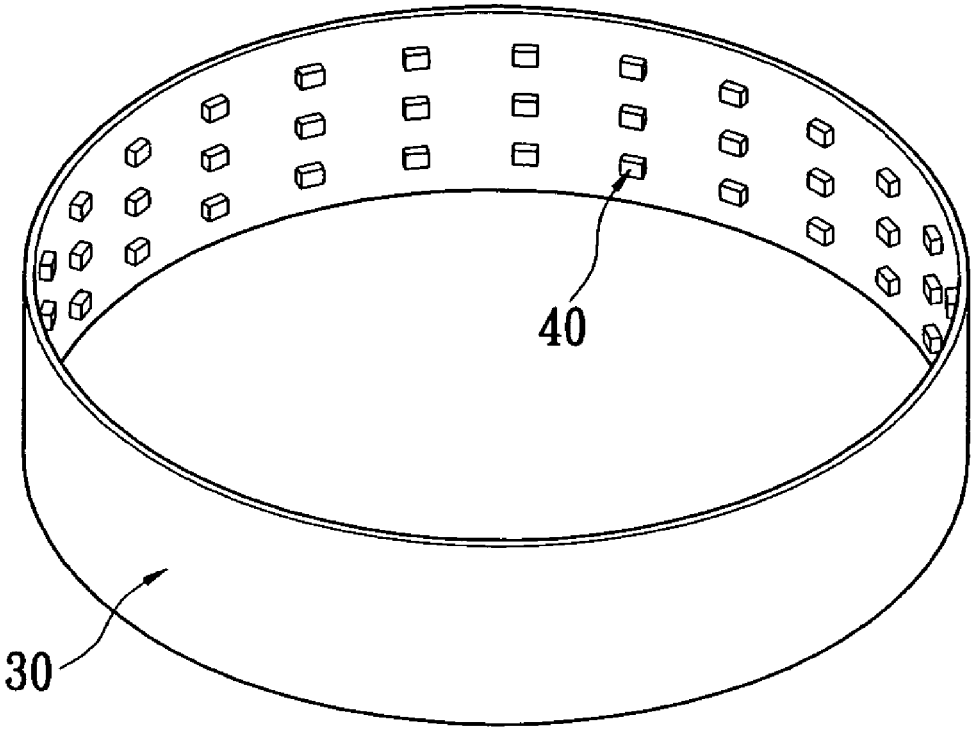
FIG. 11 is a schematic view showing the flexible circuit structure of the light-emitting fan of the present invention being provided with rows of first light-emitting elements.

Furthermore, although the flexible circuit structures 30, 50 are exemplarily described as flexible printed circuit board, they are not limited thereto. Since it is easier to increase circuit on the flexible printed circuit board, more first light-emitting elements 40 can be arranged. Thus, it is possible to control the changeable light effect generated by the first light-emitting elements 40. The first light-emitting elements 40 can be arranged as a plurality of rows (FIG. 11) on the flexible circuit structure 30. Alternatively, the first light-emitting elements can be arranged in a form of desired patterns or characters. According to the above, the advantages of using the flexible printed circuit board lies in better expandability and functionality.

Of course, the flexible circuit structures 30, 50 also comprise other circuit structures. For example, a flexible transparent element (e.g. sleeve) is provided with a circuit to be electrically connected to the first light-emitting elements 40, thereby emitting light.

According to the above, in the light-emitting fan of the present invention, the flexible circuit structure can be connected to a plurality of light-emitting elements directly. Therefore, the construction of the frame can be simplified, and it is unnecessary to connect with the light-emitting elements via leads. The flexible circuit structure can be combined on the frame by means of adhering, via screws, locking, or the like. Therefore, it is much easier to manufacture and assemble the fan.

Furthermore, in the light-emitting fan of the present invention, the light-emitting elements can be arranged in a ring and the number thereof is greater than or equal to the number of the blades of the vane. Therefore, when the fan is in operation, the vane and the light emitted by the light-emitting elements can cooperate with each other to generate a shining visual effect.

While the present invention has been described in terms of what is presently considered to be the most practical and preferred embodiments, it is to be understood that the present invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A light-emitting fan, comprising:

a frame having a ring portion;

a vane pivotally provided on the frame, the vane having a hub and a plurality of blades connected to the hub;

at least one flexible circuit structure provided circumferentially around an inner or an outer surface of the ring portion of the frame; and a plurality of light-emitting elements provided on the flexible circuit structure and electrically connected to the flexible circuit structure.

2. The light-emitting fan according to claim 1, wherein the frame is made of transparent or translucent materials.

3. The light-emitting fan according to claim 1, wherein the frame comprises a first casing and a second casing, the first casing and the second casing are provided respectively with locking portions to be locked with each other, thereby combining the first casing and the second casing with each other.

4. The light-emitting fan according to claim 1, wherein the vane is made of transparent or translucent materials.

5. The light-emitting fan according to claim 1, wherein the flexible circuit structure encircles to form a ring.

6. The light-emitting fan according to claim 1, wherein the flexible circuit structure is circumferentially provided on an inner edge or outer edge of the frame.

7. The light-emitting fan according to claim 1, wherein a number of the flexible circuit structures are circumferentially provided on the inner edge of the frame at intervals, and the light-emitting elements are provided on the flexible circuit structures correspondingly.

8. The light-emitting fan according to claim 1, wherein a number of the flexible circuit structures are circumferentially provided on the outer edge of the frame at intervals, and the light-emitting elements are provided on the flexible circuit structures correspondingly.

9. The light-emitting fan according to claim 1, wherein the flexible circuit structure is a flexible printed circuit board.

10. The light-emitting fan according to claim 1, wherein the light emitted by the light-emitting elements illuminates the vane.

11. The light-emitting fan according to claim 10, wherein the number of the light-emitting elements is greater than or equal to the number of the blades, so that the light emitted by the light-emitting elements generates a shining visual effect on the vane.

12. The light-emitting fan according to claim 11, wherein the light-emitting element is a surface mount type light-emitting diode.

13. The light-emitting fan according to claim 1, further comprising another group of light-emitting elements, the center of the frame being provided with a base, the another group of light-emitting elements being circumferentially provided on the base.

14. The light-emitting fan according to claim 13, wherein the light-emitting element is a surface mount type light-emitting diode.

15. The light-emitting fan according to claim 1, wherein the light-emitting element is a surface mount type light-emitting diode.

* * * * *